US005714018A

United States Patent [19]

Kita et al.

[11] Patent Number: 5,714,018

[45] Date of Patent: Feb. 3, 1998

[54] HIGH-STRENGTH AND HIGH-TOUGHNESS ALUMINUM-BASED ALLOY

[75] Inventors: Kazuhiko Kita, Uozu; Hidenobu Nagahama, Kurobe; Takeshi Terabayashi, Nyuzen-machi; Makoto Kawanishi, Kurobe, all of Japan

[73] Assignee: YKK Corporation, Tokyo, Japan

[21] Appl. No.: 967,195

[22] Filed: Oct. 27, 1992

[30] Foreign Application Priority Data

Nov. 1, 1991 [JP] Japan ..... 3-287921

[51] Int. Cl.[6] ..... C22C 21/00

[52] U.S. Cl. ..... 148/550; 148/437; 148/438; 148/439; 148/440; 148/550; 148/539; 148/415; 148/416; 148/417; 148/418; 420/528; 420/529; 420/540; 420/542; 420/535; 420/541; 420/550; 420/551; 420/552; 420/553; 420/548; 420/544

[58] Field of Search ..... 148/437, 438, 148/439, 440, 550, 539, 415, 416, 417, 418; 420/528, 529, 540, 542, 535, 541, 550, 551, 552, 553, 548, 544

[56] References Cited

U.S. PATENT DOCUMENTS 5,053,085 10/1991 Masumoto et al. ..... 148/439

FOREIGN PATENT DOCUMENTS 4-154933 5/1992 Japan .

*Primary Examiner*—David A. Simmons
*Assistant Examiner*—M. Alexandra Elve
*Attorney, Agent, or Firm*—Flynn, Thiel, Boutell & Tanis, P.C.

[57] ABSTRACT

A high-strength and high-toughness aluminum-based alloy having a composition represented by the general formula: $Al_aNi_bX_cM_dQ_e$, wherein X is at least one element selected from the group consisting of La, Ce, Mm, Ti and Zr; M is at least one element selected from the group consisting of V, Cr, Mn, Fe, Co, Y, Nb, Mo, Hf, Ta and W; Q is at least one element selected from the group consisting of Mg, Si, Cu and Zn; and a, b, c, d and e are, in atomic percentage, $83 \leqq a \leqq 94.3$, $5 \leqq b \leqq 10$, $0.5 \leqq c \leqq 3$, $0.1 \leqq d \leqq 2$, and $0.1 \leqq e \leqq 2$. The aluminum-based alloy has a high strength and an excellent toughness and can maintain the excellent characteristics provided by a quench solidification process even when subjected to thermal influence at the time of working. In addition, it can provide an alloy material having a high specific strength by virtue of minimized amounts of elements having a high specific gravity to be added to the alloy.

3 Claims, 1 Drawing Sheet

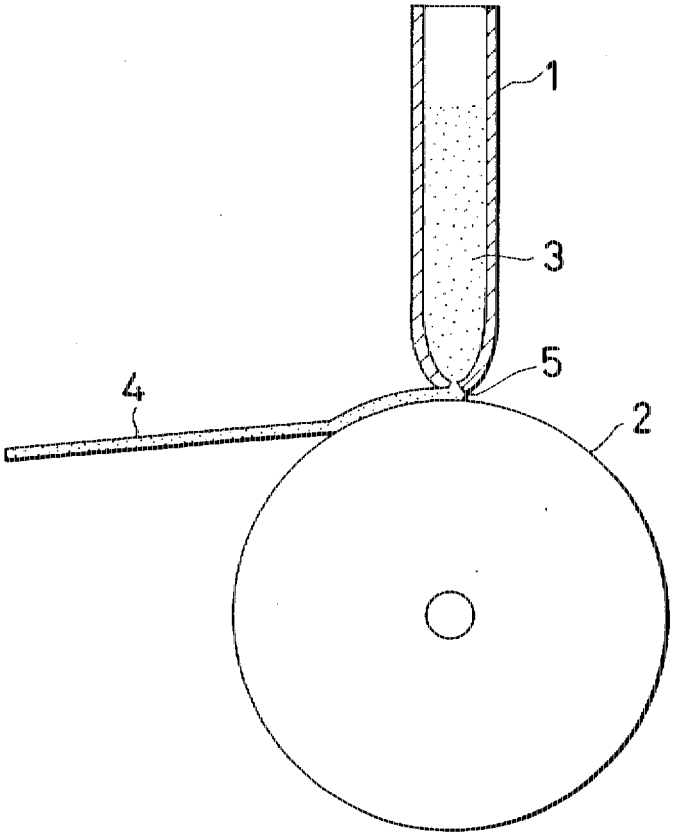
1
3
5
4
2

HIGH-STRENGTH AND HIGH-TOUGHNESS ALUMINUM-BASED ALLOY

BACKGROUND OF THE INVENTION

1. Field of the Invention

The present invention relates to an aluminum-based alloy having a high strength and an excellent toughness which is produced by a quench solidification process.

2. Description of the Prior Art

An aluminum-based alloy having a high strength and a high heat resistance has heretofore been produced by a liquid quenching process as disclosed especially in Japanese Patent Laid-Open No. 275732/1989. The aluminum-based alloy obtained by the liquid quenching process is an amorphous or microcrystalline alloy and is an excellent alloy having a high strength, a high heat resistance and a high corrosion resistance.

Although the above conventional aluminum-based alloy is an excellent alloy which exhibits a high strength, a high heat resistance and a high corrosion resistance and is also excellent in workability in spite of this being a high-strength material, it still admits of further improvement in toughness when used as the material required to have a high toughness. As a general rule, an alloy produced by a quench solidification process involves the problems that it is susceptible to thermal influence during working and that it suddenly loses the excellent characteristics such as a high strength owing to the thermal influence. The above-mentioned aluminum-based alloy is not the exception to the aforestated general rule and still leaves some room for further improvement in this respect.

SUMMARY OF THE INVENTION

In view of the above, an object of the present invention is to provide a high-strength and high-toughness aluminum-based alloy capable of maintaining its excellent characteristics provided by the quench solidification process as well as a high strength and a high toughness even if it is subjected to the thermal influence at the time of working.

The present invention provides a high-strength and high-toughness aluminum-based alloy having a composition represented by the general formula:

$$Al_aNi_bX_cM_dQ_e$$

wherein X is at least one element selected from the group consisting of La, Ce, Mm (misch metal), Ti and Zr; M is at least one element selected from the group consisting of V, Cr, Mn, Fe, Co, Y, Nb, Mo, Hf, Ta and W; Q is at least one element selected from the group consisting of Mg, Si, Cu and Zn; and a, b, c, d and e are, in atomic percentage, $83 \leqq a \leqq 94.3$, $5 \leqq b \leqq 10$, $0.5 \leqq c \leqq 3$, $0.1 \leqq d \leqq 2$ and $0.1 \leqq e \leqq 2$.

BRIEF DESCRIPTION OF THE DRAWINGS

The single FIGURE is an explanatory drawing showing one example of the apparatus well suited for the production of the alloy according to the present invention.

DETAILED DESCRIPTION OF THE PREFERRED EMBODIMENTS

In the above-mentioned alloy of the present invention, Ni element has an excellent ability to form an amorphous phase or a supersaturated solid solution and serves for the refinement of the crystalline structure of the alloy including the intermetallic compounds and for the production of a high-strength alloy by a quench solidification process. The content of Ni in the above alloy is limited to 5 to 10 atomic % because a content thereof less than 5 atomic % leads to an insufficient strength of the alloy obtained by rapid quenching, whereas that exceeding 10 atomic % results in a sudden decrease in the toughness (ductility) of the alloy thus obtained.

The element X is at least one element selected from the group consisting of La, Ce, Mm, Ti and Zr and serves to enhance the thermal stability of the amorphous structure, supersaturated solid solution or microcrystalline structure as well as the strength of the alloy. The content of the element X in the above alloy is limited to 0.5 to 3 atomic % because a content thereof less than 0.5 atomic % leads to insufficiency of the above-mentioned effect, whereas that exceeding 3 atomic % results in a sudden decrease in the toughness (ductility) of the alloy thus obtained.

The element M is at least one element selected from the group consisting of V, Cr, Mn, Fe, Co, Y, Nb, Mo, Hf, Ta and W and serves to enhance the thermal stability of the rapidly solidified structure such as the amorphous structure, supersaturated solid solution or microcrystalline structure and to maintain the above-described characteristics even when the alloy is subjected to thermal influence. The addition of the element M in a slight amount to the alloy does not exert any adverse influence on the excellent toughness (ductility) of the Al—Ni—X-based alloy. The content of the element M in the above alloy is limited to 0.1 to 2 atomic % because a content thereof less than 0.1 atomic % leads to insufficiency of the above-mentioned effect, whereas that exceeding 2 atomic % results in the action of inhibiting the refinement of the aforestated rapidly solidified structure and exerts evil influence on the toughness (ductility) of the alloy thus obtained.

The element Q is effective when a microcrystalline structure, especially a supersaturated solid solution state or a composite structure with intermetallic compounds is obtained and is capable of strengthening the matrix structure, enhancing the thermal stability and improving the specific rigidity as well as the specific strength of the alloy as the above element forms a solid solution with the crystalline Al or disperses in grains as a compound thereof. The content of the element Q in the above alloy is limited to 0.1 to 2 atomic % because a content thereof less than 0.1 atomic % leads to insufficiency of the above-described effect, while that exceeding 2 atomic % results in the action of inhibiting the refinement of the rapidly solidified structure and exerts evil influence on the toughness (ductility) of the alloy as is the case with the above element M.

The aluminum-based alloy according to the present invention is obtained by rapidly solidifying the melt of the alloy having the aforestated composition by a liquid quenching process. The cooling rate of $10^4$ to $10^6$ K/sec in this case is particularly effective.

Now, the present invention will be described in more detail with reference to the Example.

EXAMPLE

A molten alloy 3 having a given composition was prepared with a high-frequency melting furnace, introduced into a quartz tube 1 having a small hole 5 of 0.5 mm in diameter at the end thereof as shown in the figure, and melted by heating. Thereafter, the quartz tube 1 was placed immediately above a copper roll 2. Then the molten alloy 3 in the quartz tube 1 was ejected onto the roll 2 from the small hole 5 of the quartz tube 1 at a high speed of the roll 2 of 3000 to 5000 rpm under a pressure of argon gas of 0.7 kg/cm$^2$ and brought into contact with the surface of the roll 2 to obtain a rapidly solidified alloy thin ribbon 4.

There were obtained by the aforesaid production conditions, 29 kinds of thin ribbons of 1 mm in width and 20 μm in thickness each having a composition by atomic % as given in Table 1. It was confirmed as the result of X-ray diffraction for each of the ribbons that both amorphous alloys and composite alloys composed of an amorphous phase and a microcrystalline phase were obtained as shown on the right end column in Table 1. The results of observation on the samples of the above composite alloys under a TEM (transmission electron microscope) gave a mixed phase structure in which an FCC (face-centered cubic) crystalline phase was homogeneously and finely dispersed in an amorphous phase. In Table 1,"amorph" and "microcryst" represent "amorphous" and "microcrystalline", respectively.

TABLE 1

| | Composition (atomic %) | | | | | |
|---|---|---|---|---|---|---|
| | Al | Ni | X | M | Q | Phase structure |
| Invention Ex. 1 | balance | 10 | Mm = 1.0, Ti = 0.2 | Cr = 0.3 | Cu = 0.1 | amorph. + microcryst. |
| Comp. Ex. 1 | balance | 10 | Mm = 1.0, Ti = 0.2 | — | — | amorph. + microcryst. |
| Invention Ex. 2 | balance | 10 | Mm = 1.5 | Co = 0.3 | Mg = 0.1 | amorph. + microcryst. |
| Comp. Ex. 2 | balance | 10 | Mm = 1.5 | — | — | amorph. + microcryst. |
| Invention Ex. 3 | balance | 9 | Mm = 2.3 | Cr = 0.5 | Si = 0.5 | amorph. |
| Comp. Ex. 3 | balance | 9 | Mm = 2.3 | — | — | amorph. |
| Invention Ex. 4 | balance | 8 | Zr = 2.8 | V = 1.7 | Mg = 0.8, Si = 0.6 | amorph. |
| Comp. Ex. 4 | balance | 8 | Zr = 2.8 | — | — | amorph. |
| Invention Ex. 5 | balance | 8 | Ti = 1.0 | Mo = 0.4 | Cu = 0.4 | amorph. + microcryst. |
| Comp. Ex. 5 | balance | 8 | Ti = 1.0 | — | — | amorph. + microcryst. |
| Invention Ex. 6 | balance | 7 | Mm = 2.0 | Hf = 1.2 | Mg = 0.2, Zn = 0.1 | amorph. + microcryst. |
| Comp. Ex. 6 | balance | 7 | Mm = 2.0 | — | — | amorph. + microcryst. |
| Invention Ex. 7 | balance | 6 | Mm = 2.6 | Y = 0.8 | Si = 0.6 | amorph. |
| Comp. Ex. 7 | balance | 6 | Mm = 2.6 | — | — | amorph. |
| Invention Ex. 8 | balance | 5 | Mm = 2.0 | Mo = 0.4, Cr = 1.0 | Si = 1.6 | amorph. |
| Comp. Ex. 8 | balance | 5 | Mm = 2.0 | — | — | amorph. |
| Invention Ex. 9 | balance | 5 | Zr = 2.0 | Cr = 0.3 | Mg = 0.3, Zn = 0.1 | amorph. + microcryst. |
| Comp. Ex. 9 | balance | 5 | Zr = 2.0 | — | — | amorph. + microcryst. |
| Invention Ex. 10 | balance | 10 | Mm = 1.2 | V = 0.3 | Cu = 0.1 | amorph. + microcryst. |
| Comp. Ex. 10 | balance | 10 | Mm = 1.2 | — | — | amorph. + microcryst. |
| Invention Ex. 11 | balance | 10 | Mm = 1.0, Ti = 0.2 | Y = 1.0 | Mg = 0.2 | amorph. + microcryst. |
| Comp. Ex. 11 | balance | 10 | Mm = 1.0, Ti = 0.2 | — | — | amorph. + microcryst. |
| Invention Ex. 12 | balance | 10 | Ti = 1.0 | W = 0.3 | Si = 0.5 | amorph. + microcryst. |
| Comp. Ex. 12 | balance | 10 | Ti = 1.0 | — | — | amorph. + microcryst. |
| Invention Ex. 13 | balance | 9 | Zr = 2.5 | Cr = 1.2 | Mg = 0.5, Si = 0.3 | amorph. |
| Comp. Ex. 13 | balance | 9 | Zr = 2.5 | — | — | amorph. |
| Invention Ex. 14 | balance | 9 | La = 3.0 | Ta = 0.1 | Mg = 0.7, Zn = 0.3 | amorph. + microcryst. |
| Comp. Ex. 14 | balance | 9 | La = 3.0 | — | — | amorph. |
| Invention Ex. 15 | balance | 9 | Mm = 1.5, Ti = 0.2 | Hf = 1.0 | Cu = 0.4 | amorph. |
| Comp. Ex. 15 | balance | 9 | Mm = 1.5, Ti = 0.2 | — | — | amorph. + microcryst. |
| Invention Ex. 16 | balance | 8 | Ce = 1.0 | Mo = 0.5 | Mg = 0.2, Cu = 0.1 | amorph. + microcryst. |
| Comp. Ex. 16 | balance | 8 | Ce = 1.0 | — | — | amorph. + microcryst. |
| Invention Ex. 17 | balance | 8 | Mm = 1.5, Zr = 0.3 | Nb = 1.2 | Mg = 1.5, Si = 0.5 | amorph. + microcryst. |
| Comp. Ex. 17 | balance | 8 | Mm = 1.5, Zr = 0.3 | — | — | amorph. + microcryst. |
| Invention Ex. 18 | balance | 8 | Ti = 2.7 | Co = 2.0 | Zn = 0.3 | amorph. + microcryst. |
| Comp. Ex. 18 | balance | 8 | Ti = 2.7 | — | — | amorph. + microcryst. |
| Invention Ex. 19 | balance | 8 | Zr = 2.3 | Fe = 0.5 | Mg = 0.5 | amorph. + microcryst. |
| Comp. Ex. 19 | balance | 8 | Zr = 2.3 | — | — | amorph. |
| Invention Ex. 20 | balance | 7 | Mm = 1.5, Zr = 0.2 | Mn = 1.3 | Si = 1.2 | amorph. + microcryst. |
| Comp. Ex. 20 | balance | 7 | Mm = 1.5, Zr = 0.2 | — | — | amorph. + microcryst. |
| Invention Ex. 21 | balance | 7 | Ti = 1.6 | Cr = 0.2 | Mg = 1.0 | amorph. + microcryst. |
| Comp. Ex. 21 | balance | 7 | Ti = 1.6 | — | — | amorph. + microcryst. |
| Invention Ex. 22 | balance | 7 | Mn = 1.0, Ti = 1.2 | Mn = 0.6 | Cu = 0.7 | amorph. + microcryst. |
| Comp. Ex. 22 | balance | 7 | Mm = 1.0, Ti = 1.2 | — | — | amorph. + microcryst. |
| Invention Ex. 23 | balance | 7 | Mm = 2.2 | V = 0.7 | Mg = 0.2, Si = 0.3 | amorph. + microcryst. |
| Comp. Ex. 23 | balance | 7 | Mm = 2.2 | — | — | amorph. + microcryst. |
| Invention Ex. 24 | balance | 6 | Zr = 1.3 | Y = 0.4 | Mg = 1.3 | amorph. + microcryst. |
| Comp. Ex. 24 | balance | 6 | Zr = 1.3 | — | — | amorph. + microcryst. |
| Invention Ex. 25 | balance | 6 | Mm = 2.6 | Hf = 0.1 | Cu = 1.2 | amorph. + microcryst. |
| Comp. Ex. 25 | balance | 6 | Mm = 2.6 | — | — | amorph. + microcryst. |
| Invention Ex. 26 | balance | 6 | Ti = 1.9 | Cr = 1.4 | Zn = 0.3 | amorph. + microcryst. |
| Comp. Ex. 26 | balance | 6 | Ti = 1.9 | — | — | amorph. + microcryst. |
| Invention Ex. 27 | balance | 5 | Mm = 2.0, Ti = 0.4 | W = 0.2 | Cu = 1.5 | amorph. + microcryst. |
| Comp. Ex. 27 | balance | 5 | Mm = 2.0, Ti = 0.4 | — | — | amorph. + microcryst. |
| Invention Ex. 28 | balance | 5 | Zr = 1.2 | Mn = 1.5 | Si = 0.2 | amorph. + microcryst. |
| Comp. Ex. 28 | balance | 5 | Zr = 1.2 | — | — | amorph. + microcryst. |
| Invention Ex. 29 | balance | 5 | Mm = 2.2, Ti = 0.2 | Mo = 0.3 | Zn = 0.3, Mg = 1.2 | amorph. + microcryst. |
| Comp. Ex. 29 | balance | 5 | Mm = 2.2, Ti = 0.2 | — | — | amorph. + microcryst. |

Each of the samples of the above thin ribbons obtained under the aforementioned production conditions was tested for the tensile strength $\sigma_B$(MPa) both at room temperature and in a 473K (200° C.) atmosphere, and toughness (ductility). The results are given on the right-hand column in Table 2. The tensile strength in the 473K atmosphere was tested at 473K after the thin ribbon sample was maintained at 473K for 100 hours.

TABLE 2

| | Room temp. $\sigma_B$ (MPa) | 473K $\sigma_B$ (MPa) |
|---|---|---|
| Invention Ex. 1 | 1047 | 653 |
| Comp. Ex. 1 | 952 | 593 |
| Invention Ex. 2 | 967 | 627 |
| Comp. Ex. 2 | 925 | 582 |
| Invention Ex. 3 | 967 | 593 |
| Comp. Ex. 3 | 880 | 523 |
| Invention Ex. 4 | 923 | 670 |
| Comp. Ex. 4 | 871 | 607 |
| Invention Ex. 5 | 917 | 616 |
| Comp. Ex. 5 | 823 | 567 |
| Invention Ex. 6 | 960 | 617 |
| Comp. Ex. 6 | 882 | 547 |
| Invention Ex. 7 | 857 | 586 |
| Comp. Ex. 7 | 803 | 547 |
| Invention Ex. 8 | 899 | 599 |
| Comp. Ex. 8 | 828 | 548 |
| Invention Ex. 9 | 876 | 569 |
| Comp. Ex. 9 | 798 | 502 |
| Invention Ex. 10 | 1047 | 653 |
| Comp. Ex. 10 | 940 | 588 |
| Invention Ex. 11 | 967 | 627 |
| Comp. Ex. 11 | 872 | 563 |
| Invention Ex. 12 | 956 | 593 |
| Comp. Ex. 12 | 850 | 532 |
| Invention Ex. 13 | 928 | 670 |
| Comp. Ex. 13 | 826 | 599 |
| Invention Ex. 14 | 1023 | 697 |
| Comp. Ex. 14 | 921 | 620 |
| Invention Ex. 15 | 942 | 616 |
| Comp. Ex. 15 | 857 | 540 |
| Invention Ex. 16 | 897 | 603 |
| Comp. Ex. 16 | 812 | 523 |
| Invention Ex. 17 | 924 | 632 |
| Comp. Ex. 17 | 884 | 562 |
| Invention Ex. 18 | 955 | 621 |
| Comp. Ex. 18 | 865 | 554 |
| Invention Ex. 19 | 894 | 569 |
| Comp. Ex. 19 | 810 | 511 |
| Invention Ex. 20 | 876 | 599 |
| Comp. Ex. 20 | 792 | 580 |
| Invention Ex. 21 | 956 | 617 |
| Comp. Ex. 21 | 866 | 552 |
| Invention Ex. 22 | 875 | 623 |
| Comp. Ex. 22 | 789 | 555 |
| Invention Ex. 23 | 924 | 611 |
| Comp. Ex. 23 | 840 | 545 |
| Invention Ex. 24 | 885 | 588 |
| Comp. Ex. 24 | 810 | 523 |
| Invention Ex. 25 | 915 | 612 |
| Comp. Ex. 25 | 825 | 545 |
| Invention Ex. 26 | 942 | 653 |
| Comp. Ex. 26 | 860 | 582 |
| Invention Ex. 27 | 902 | 623 |
| Comp. Ex. 27 | 813 | 556 |

TABLE 2-continued

| | Room temp. $\sigma_B$ (MPa) | 473K $\sigma_B$ (MPa) |
|---|---|---|
| Invention Ex. 28 | 865 | 577 |
| Comp. Ex. 28 | 778 | 512 |
| Invention Ex. 29 | 855 | 545 |
| Comp. Ex. 29 | 780 | 485 |

As can be seen from Table 2, the aluminum-based alloy according to the present invention has a high strength at both room temperature and an elevated temperature, that is, a tensile strength of 850 MPa or higher at room temperature and that of 500 MPa or higher in the 473K atmosphere without a great decrease in the strength at an elevated temperature; besides it has an elongation of 1% or greater at room temperature, rendering itself a material excellent in toughness.

As has been described hereinbefore, the aluminum-based alloy according to the present invention possesses a high strength and a high toughness and can maintain the excellent characteristics provided by a quench solidification process even when subjected to thermal influence at the time of working. In addition, it can provide an alloy material having a high specific strength by virtue of minimized amounts of elements having a high specific gravity to be added to the alloy.

What is claimed is:

1. A high-strength and high-toughness aluminum-based alloy having a composition represented by the general formula:

$$Al_aNi_bX_cM_dQ_e$$

wherein X is at least one element selected from the group consisting of La, Ce, Mm (misch metal), Ti and Zr; M is at least one element selected from the group consisting of V, Cr, Mn, Fe, Co, Y, Nb, Mo, Hf, Ta and W; Q is at least one element selected from the group consisting of Mg, Si, Cu and Zn; and a, b, c, d and e are, in atomic percentage, $83 \leqq a \leqq 94.3$, $5 \leqq b \leqq 10$, $0.5 \leqq c \leqq 3$, $0.1 \leqq d \leqq 2$ and $0.1 \leqq e \leqq 2$.

2. A high strength and high-toughness and aluminum-based alloy according to claim 1, wherein said high strength and high-toughness alminum-based alloy has, at room temperature, a strength of at least 850 MPa and an elongation of at least 1%.

3. A high strength and high-toughness aluminum-based alloy according to claim 1, wherein said high strength and high-toughness aluminum-based alloy has a strength of at least 500 MPa at 200°C. (473K).

* * * * *

UNITED STATES PATENT AND TRADEMARK OFFICE

CERTIFICATE OF CORRECTION

PATENT NO. : 5,714,018

DATED : February 3, 1998

INVENTOR(S) : Kazuhiko KITA et al

It is certified that error appears in the above-indentified patent and that said Letters Patent is hereby corrected as shown below:

Abstract line 9; change "94,3" to ---94.3---.

Column 6, line 43; change "high-toughness and aluminum" to ---high-toughness aluminum---.

Signed and Sealed this

Seventh Day of July, 1998

Bruce Lehman

*Attest:*

BRUCE LEHMAN

*Attesting Officer*

*Commissioner of Patents and Trademarks*